US010596686B2

(12) United States Patent
Söderlund

(10) Patent No.: US 10,596,686 B2
(45) Date of Patent: Mar. 24, 2020

(54) PNEUMATIC IMPULSE WRENCH WITH POWER CONTROL UNIT

(71) Applicant: ATLAS COPCO INDUSTRIAL TECHNIQUE AB, Stockholm (SE)

(72) Inventor: Per Thomas Söderlund, Värmdö (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 206 days.

(21) Appl. No.: 15/577,197

(22) PCT Filed: Jun. 3, 2016

(86) PCT No.: PCT/EP2016/062633
§ 371 (c)(1),
(2) Date: Nov. 27, 2017

(87) PCT Pub. No.: WO2016/198330
PCT Pub. Date: Dec. 15, 2016

(65) Prior Publication Data

US 2018/0169843 A1 Jun. 21, 2018

(30) Foreign Application Priority Data

Jun. 9, 2015 (SE) ..... 1550757

(51) Int. Cl.
*B25B 23/145* (2006.01)

(52) U.S. Cl.
CPC ..... *B25B 23/1453* (2013.01); *B25B 23/1456* (2013.01)

(58) Field of Classification Search
CPC ..... B25B 23/1453; B25B 23/145; B25F 5/00; B25D 9/08

(Continued)

(56) References Cited

U.S. PATENT DOCUMENTS 5,775,439 A * 7/1998 Biek ..... B25B 21/02 173/1
6,135,213 A * 10/2000 Schoeps ..... B25B 21/00 173/169

(Continued)

FOREIGN PATENT DOCUMENTS

WO 2014072174 A1 5/2014

OTHER PUBLICATIONS

International Search Report (ISR) and Written Opinion dated Sep. 21, 2016 issued in International Application No. PCT/EP2016/062633.

*Primary Examiner* — Andrew M Tecco
(74) *Attorney, Agent, or Firm* — Holtz, Holtz & Volek PC

(57) ABSTRACT

A pneumatic impulse wrench includes a housing with a motor powered impulse unit, a pressure air inlet passage, an exhaust air outlet passage located in the housing and connected to the motor, and a motor power controlling valve mechanism located in the exhaust air outlet passage for automatic control of the exhaust air flow from the motor. A control pressure passage extends between the air inlet passage and the valve mechanism for communicating actual air inlet pressure to the valve mechanism. An operating mode shifting valve is provided in the housing and which is shiftable between an open position in which communication is allowed through the control pressure passage in an automatic valve mechanism operating mode, and a closed position in which communication through the control pressure passage is blocked in a manual valve mechanism operating mode.

13 Claims, 4 Drawing Sheets

(58) Field of Classification Search
USPC ..... 173/169
See application file for complete search history.

(56) References Cited

U.S. PATENT DOCUMENTS

| | | | | |
|---|---|---|---|---|
| 6,991,043 | B1 * | 1/2006 | Chen | B25F 5/00 173/168 |
| 2011/0107881 | A1 * | 5/2011 | Nelson | B25B 23/1453 81/470 |
| 2014/0034159 | A1 * | 2/2014 | Myrhum, Jr. | F16K 15/18 137/561 R |
| 2015/0217438 | A1 | 8/2015 | Myrhum | |
| 2017/0312899 | A1 * | 11/2017 | Jansson | B25B 21/02 |

* cited by examiner

PNEUMATIC IMPULSE WRENCH WITH POWER CONTROL UNIT

The invention relates to a pneumatic impulse wrench provided with a motor power control means by which the exhaust air flow from the motor is controlled in response to the actual torque load on the motor. In particular, the invention concerns a pneumatic impulse wrench having a motor power control means which comprises an exhaust air flow determining valve mechanism operated by the actual pressure in the air inlet to the motor.

The purpose of this motor power control means is to accomplish a reduction of the motor power and speed at impulse wrenches during the low load operation sequences occurring during the running down sequence of a screw joint. If the running down sequence of a screw joint is performed at full motor power a very high speed and a subsequent high kinetic energy is built up in the rotating parts of the wrench, which means that the very first delivered impulse delivered to the screw joint would possess a very high energy. At a so called stiff screw joint, i.e. a screw joint having a steep torque growth in relation to rotation angle, there would be a considerable risk for over-tightening, i.e. reaching beyond the desired target torque level already by the very first delivered impulse. This is avoided by employing a motor power control means according to the invention.

A pneumatic impulse wrench having a power control means of the above mentioned type is previously described in U.S. Pat. No. 6,135,213. This known impulse wrench comprises a motor power control means comprising an exhaust air controlling valve mechanism which is incorporated in an external exhaust air outlet unit attached to the tool housing and automatically controlled by the actual pressure in the air inlet passage to the motor.

A problem related to impulse wrenches of the above type is that it lacks means for alternative operation modes for adjusting the exhaust air controlling valve mechanism, i.e. there is no means provided for omitting the automatic valve control mode and enable a manual setting of the exhaust air outlet area to thereby obtain a non-variable speed limitation of the wrench motor, which is desirable in some screw joint tightening applications.

Another disadvantage of this previously described power control means is included in a separate external outlet unit which is exposed to physical damage. Although this valve mechanism is included in a separate unit which may be readily replaceable in case of damage, a damage to the outlet unit would still cause the operator a lot of trouble and a costly interruption of the use of tool.

It is an object of the invention to provide a pneumatic impulse wrench with a power control means in the form of an exhaust air flow determining valve mechanism adapted to operate in two alternative modes, namely in an automatic operation mode wherein the valve mechanism is arranged to control the exhaust air outlet flow in response to the actual torque load on the motor, and in a manual operation mode wherein the valve mechanism is arranged to be manually adjusted and set in a fixed position to provide a constant exhaust air outlet flow area.

Another object of the invention is to provide a pneumatic impulse wrench with a power control means in the form of an exhaust air flow determining valve mechanism located inside the wrench housing well protected from external damage.

Further objects and advantages of the invention will appear from the following specification and claims.

A preferred embodiment of the invention is below described in detail with reference to the accompanying drawings.

In the drawing

Figure 1:
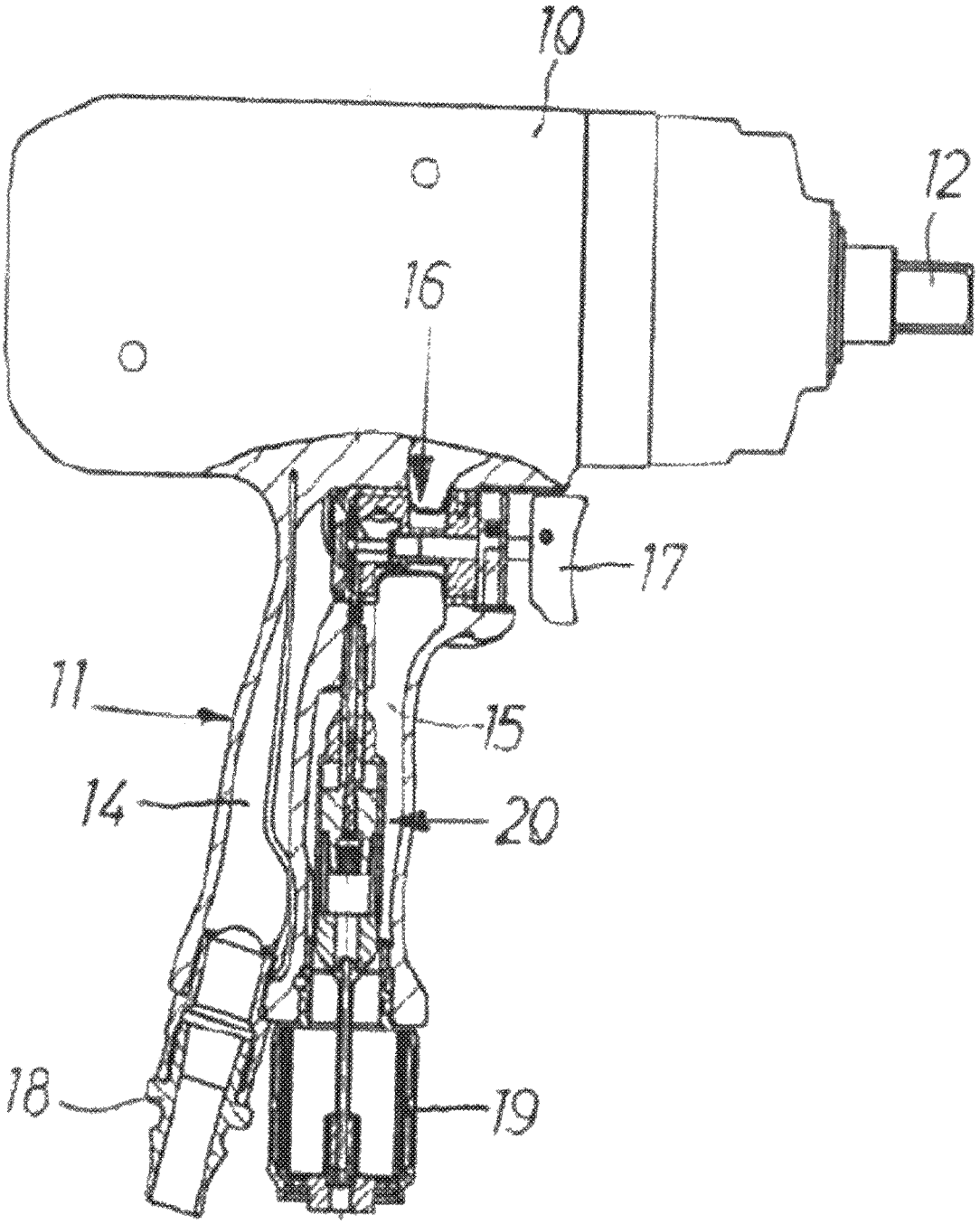
FIG. 1 shows a side view, partly in section, of an impulse wrench according to the invention.
Figure 2:
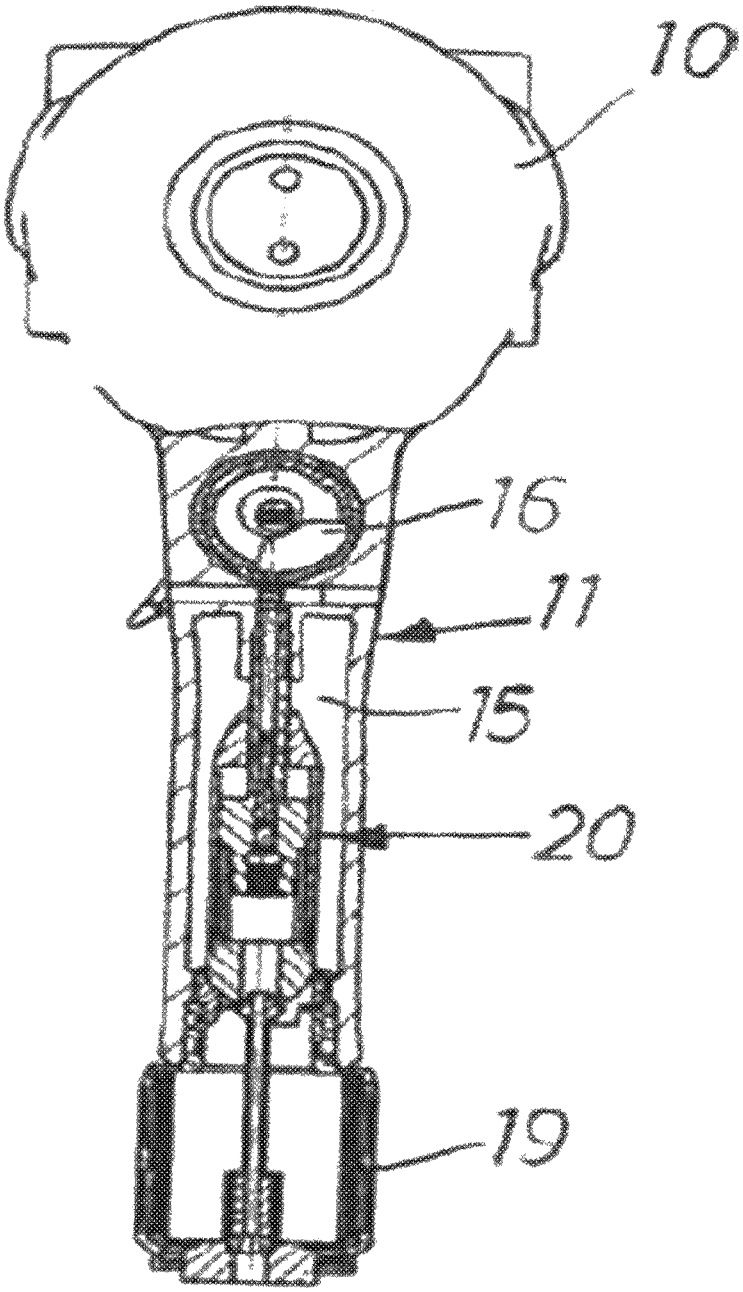
FIG. 2 shows a rear end view, partly in section, of the impulse wrench in FIG. 1.

The impulse wrench illustrated in the drawings comprises a housing 10 with a pistol type handle 11, a non-illustrated pneumatic motor and an impulse unit located inside the housing 10 in a way conventional for this type of power tools. The impulse unit is arranged to deliver torque impulses via an output shaft 12 with a square cross section.

In the handle 11 there are provided a pressure air inlet passage 14 and an exhaust air outlet passage 15, and a throttle valve 16 located in the inlet passage 14 and operated by a trigger 17 to control the pressure air supply to the motor. Apart from a control pressure opening 13, which will be described below, the throttle valve is of a conventional type and does not form part of the invention. Therefore, it will not be described in further detail. The control pressure opening 13 is situated downstream of the valve seat of the throttle valve 16 and is pressurized only when the throttle valve 16 is open.

At its lower end the handle 11 is provided with a quick coupling attachment 18 for connection of a pressure air conduit for supplying pressure air to the motor via the inlet passage 14, and an air outlet deflector 19 connected to the outlet passage in the handle 11.

Within the handle 11 there is located an outlet flow determining valve mechanism 20 by which the motor power and the low load speed is limited by regulation of the exhaust air outlet flow, and hence the back pressure on the motor. This valve mechanism 20 comprises a valve element 22 movable between a flow restricting position and an outlet flow non-restricting open position, and an immobile valve seat 23 mounted in the handle 11. The valve element 22 is tubular in shape and comprises a cylinder chamber 24 in which is received a piston 25. The latter is rigidly connected to a tubular piston rod 26 which is rigidly mounted to the housing 10. The tubular piston rod 26 is connected to the control opening 13 and forms together with the control opening 13 a control pressure passage 29 which extends into the cylinder chamber 24 of the valve element 22. The valve element 22 is biased towards its closed position by a spring 27 which is located inside the valve element 22 and taking support against the piston 25. Since the control opening 13 is located at the downstream end of the throttle valve 16 the control pressure communicated to the cylinder chamber 24 via the control pressure passage 29 is pressurized only when the throttle valve 16 is open and is exposed by the very same pressure as the motor feed pressure and the back pressure from the motor during operation. The back pressure from the motor corresponds directly to the actual torque load on the motor and transplants into a control pressure to activate the valve mechanism 20.

Figure 3:
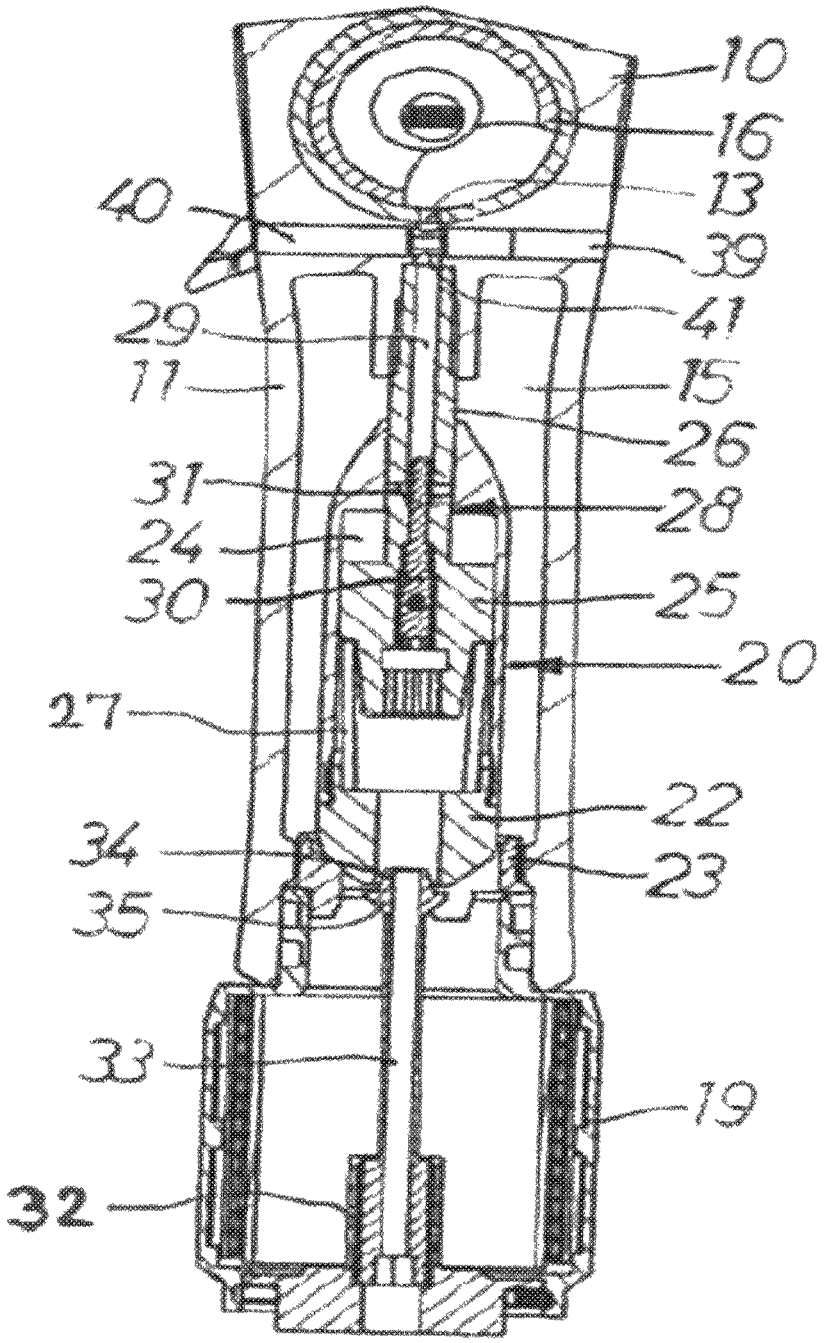
FIG. 3 shows on a larger scale the outlet flow determining valve mechanism of the impulse wrench shown in FIG. 2.

The piston 25 carries an adjustable needle valve 28 including a tapered set screw 30 threaded into the lower end of the piston 25. This needle valve 28 is intended for adjustment of the control air flow entering the cylinder chamber 24 via a couple of lateral openings 31 in the piston rod 26. See FIG. 3. By adjusting the needle valve 28 the response of the valve element 22 to the changing back pressure from the motor can be regulated.

In a threaded inner sleeve portion 32 of the outlet deflector 19 there is supported a valve setting screw 33. This valve setting screw 33 is accessible from outside and intended for manual setting a flow restricting opening of the valve mechanism 20. To this end the valve setting screw 33 extends up through the outlet deflector 19 into an endwise abutting engagement with the valve element 22. The valve element 22 is hollow and an end portion 34 of the valve setting screw 33 is received in the valve element 22 for obtaining a proper orientation of the valve setting screw 33 relative to the valve element 22. A collar 35 on the valve setting screw 33 is arranged to abut against the lower end of the valve element 22, thereby enabling application of an upward pushing force and an upward movement of the valve element 22. This makes it possible to manually obtain a desired restriction opening of the valve mechanism 20 and a suitable speed limitation of the motor at low load operation.

Since the valve setting screw 33 is not rigidly connected to the valve element 22 but instead has an abutting cooperation with the latter, occurring damage on the outlet deflector 19 would not cause any damage to the outlet flow determining valve mechanism 20.

Figure 4:
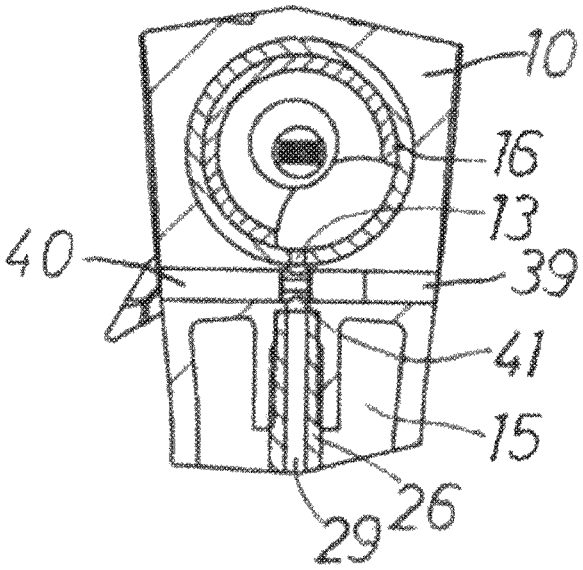
FIG. 4 shows on a larger scale a mode shifting valve illustrated in an open position.

In the housing 10 between the pressure control opening 13 in the throttle valve 16 and the piston rod 26 there is provided an operating mode shifting valve. This valve comprises a valve spindle 40 which is supported in a transverse bore 39 in the housing 1C intersecting with the control pressure passage 29. The valve spindle 40 is longitudinally displaceable by manual force in the bore 39 between an open position and a closed position. The valve spindle 40 has a waist portion 41 which is arranged to be aligned with the control passage 29 in the open position of the valve. In this position, illustrated in FIG. 4, the waist portion 41 opens up the control passage 29 such that the pressure in the inlet passage 14 will be communicated to cylinder chamber 24 of the valve mechanism 20. Thereby, the valve mechanism 20 is able to operate automatically in response to the actual back pressure from the motor in the pressure air inlet passage 14.

Figure 5:
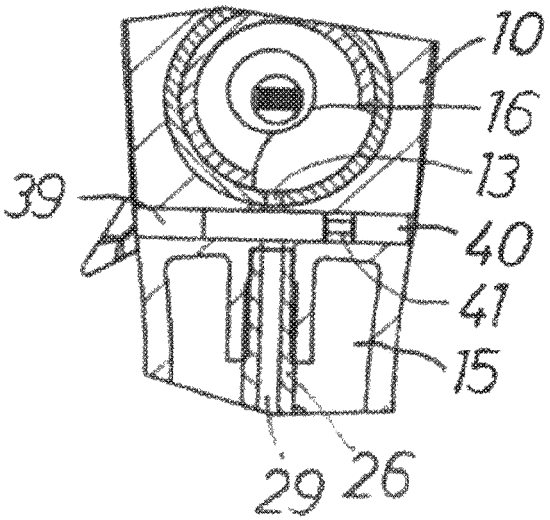
FIG. 5 shows the same view as in FIG. 3, but illustrating the mode shifting valve in a closed position.

In the closed position of the mode shifting valve, illustrated in FIG. 5, the waist portion 41 of the valve spindle 40 is out of alignment with the control passage 29, which means that the latter is blocked and no control pressure will be communicated to the valve mechanism 20. Accordingly, the valve mechanism 20 will be prevented from being automatically controlled by the back pressure from the motor. Instead, a desirable fixed outlet flow restriction may be obtained by manual setting of the outlet flow area between the valve element 22 and the seat 23. This is accomplished by adjustment of the valve setting screw 33 which is arranged to apply an upwardly directed pushing force on the valve element 25, whereby the valve element 25 is moved upwards against the action of the spring 27 until a suitable outlet flow restricting opening is obtained.

In the automatic operating mode of the valve mechanism 20 a low torque load on the motor during the running down sequence of a screw joint means a low back pressure from the motor in the inlet passage 14 which results in a low control pressure being communicated to the valve mechanism 20 via the control pressure passage 29. This low control pressure is not strong enough to move the valve element 22 upwards against the spring 27 and open up the flow opening between the valve element 22 and the seat 23. Accordingly, there will be a considerable restriction of the exhaust air outlet flow which will increase the back pressure on the motor and keep down the motor power and, hence the motor speed. This will prevent the impulse unit to deliver an undesirable too high initial torque impulse to the screw joint.

As the torque load on the motor increases during a screw joint pre-tensioning sequence the back pressure from the motor in the pressure air inlet passage as well as the control pressure increases. This means that the pressure in the cylinder chamber 24 will be strong enough to move the valve element 22 upwards against the bias force of the spring 27 and open up a larger flow opening relative to the seat 23, thereby providing for a less restrictive outlet flow and a resulting increased motor output power. Accordingly, during a final screw joint tightening sequence under heavy torque load the motor is now free to deliver full power.

The invention claimed is:

1. A pneumatic impulse wrench comprising:

a housing with an impulse unit powered by a motor;

a pressure air inlet passage;

an exhaust air outlet passage located in the housing and connected to the motor;

a motor power controlling valve mechanism located in the exhaust air outlet passage for control of exhaust air flow from the motor;

a control pressure passage extending between the air inlet passage and the valve mechanism for communicating actual air inlet pressure to the valve mechanism; and an operating mode shifting valve which is provided in the housing and which is shiftable between (i) an open position to allow communication through the control pressure passage to set the pneumatic impulse wrench in an automatic valve mechanism operating mode in which the valve mechanism automatically controls the exhaust air flow from the motor in response to an actual torque load on the motor, and (ii) a closed position to block communication through the control pressure passage to set the pneumatic impulse wrench in a manual valve mechanism operating mode in which the valve mechanism is configured to be manually adjusted and set in a fixed position.

2. The pneumatic impulse wrench according to claim 1, wherein the operating mode shifting valve comprises a valve spindle supported in a transverse bore in the housing intersecting the control pressure passage, and the valve spindle is longitudinally displaceable between the open position of the operating mode shifting valve and the closed position of the operating mode shifting valve.

3. The pneumatic impulse wrench according to claim 2, wherein the valve spindle has a waist portion which is arranged:

to be aligned with the control passage in the open position of the operating mode shifting valve; and to be out of alignment with the control passage in the closed position of the operating mode shifting valve.

4. The pneumatic impulse wrench according to claim 3, wherein the valve mechanism comprises a valve element, comprising a cylinder chamber in which a piston is received, which is associated with the valve element and arranged to be pressurized by the actual air inlet pressure communicated via the control pressure passage thereby activating the valve element in the automatic valve mechanism operating mode.

5. The pneumatic impulse wrench according to claim 4, wherein the valve mechanism comprises a valve setting screw which is provided to move the valve element into a desired exhaust flow restricting position in the manual valve mechanism operating mode.

6. The pneumatic impulse wrench according to claim 5, wherein the valve setting screw is arranged to exert a pushing force on the valve element.

7. The pneumatic impulse wrench according to claim 2, wherein the valve mechanism comprises a valve element, comprising a cylinder chamber in which a piston is received, which is associated with the valve element and arranged to be pressurized by the actual air inlet pressure communicated via the control pressure passage thereby activating the valve element in the automatic valve mechanism operating mode.

8. The pneumatic impulse wrench according to claim 7, wherein the valve mechanism comprises a valve setting screw which is provided to move the valve element into a desired exhaust flow restricting position in the manual valve mechanism operating mode.

9. The pneumatic impulse wrench according to claim 8, wherein the valve setting screw is arranged to exert a pushing force on the valve element.

10. The pneumatic impulse wrench according to claim 1, wherein the valve mechanism comprises a valve element, comprising a cylinder chamber in which a piston is received, which is associated with the valve element and arranged to be pressurized by the actual air inlet pressure communicated via the control pressure passage thereby activating the valve element in the automatic valve mechanism operating mode.

11. The pneumatic impulse wrench according to claim 10, wherein the valve mechanism comprises a valve setting screw which is provided to move the valve element into a desired exhaust flow restricting position in the manual valve mechanism operating mode.

12. The pneumatic impulse wrench according to claim 11, wherein the valve setting screw is arranged to exert a pushing force on the valve element.

13. The pneumatic impulse wrench according to claim 1, wherein the valve mechanism is located inside the housing.

* * * * *